United States Patent [19]

Kaman et al.

[11] 4,429,608

[45] Feb. 7, 1984

[54] STRINGED MUSICAL INSTRUMENT TOP

[76] Inventors: Charles H. Kaman, Prattling Pond Rd., Farmington, Conn. 06032; C. William Kaman, II, 201 Riverside Dr., Morganton, N.C. 28655

[21] Appl. No.: 285,070

[22] Filed: Jul. 20, 1981

[51] Int. Cl.[3] ..... G10D 3/02

[52] U.S. Cl. ..... 84/291; 84/452 P

[58] Field of Search ..... 84/192–193, 84/267, 275, 291, 452 P

[56] References Cited

U.S. PATENT DOCUMENTS

| | | | |
|---|---|---|---|
| 2,588,101 | 3/1952 | Finder | 84/291 |
| 3,186,288 | 6/1965 | Finch | 84/275 |
| 3,427,915 | 2/1969 | Mooney | 84/275 |

*Primary Examiner*—Lawrence R. Franklin

*Attorney, Agent, or Firm*—McCormick, Paulding & Huber

[57] ABSTRACT

A molded plastic guitar top has a sounding board with a circular sound hole located between its upper and lower ends. A plurality of integral circular reinforcing ribs concentrically arranged relative to the sound hole, project from the inner surface of the sounding board. Integral rectilinear ribs which intersect the circular ribs extend generally longitudinally of the guitar top and diverge from the circular ribs and relative to each other in the direction of the lower end of the guitar top. An integral liner projects from the inner surface of the sounding board and extends generally along the outer marginal portion of the sounding board. The guitar top is molded from thermosetting plastic sheet molding compound which comprises 40% glass and 60% resin. The sounding board portion of the top essentially comprises a mat of random glass fibers ranging in length from three inches to two feet. The reinforcing ribs or braces are formed by random chopped glass fibers not greater than one-half inch in length. The guitar top may include an integral bridge which projects from the outer surface of the sounding board and which comprises random chopped glass fibers approximately one inch in length.

17 Claims, 5 Drawing Figures

STRINGED MUSICAL INSTRUMENT TOP

BACKGROUND OF THE INVENTION

This invention relates in general to stringed musical instruments and deals more particularly with an improved top or sounding board assembly for such an instrument. The present invention is particularly concerned with an improved top for an acoustic guitar, that is, a guitar which has a hollow body and is not normally provided with electrical pickup means. In a high quality guitar of the aforedescribed general type wood is frequently used as a sounding board material. Reinforcement must generally be provided to compensate for string tension, and adds considerably to the cost of manufacturing such an instrument. Since the physical characteristics of wood vary it is difficult to manufacture instruments which have uniform sound producing qualities. The stiffness of a wood sounding board may vary with changes in humidity, for example. Further, wood sounding boards are subject to sinking, or transverse inward bowing, creep, or the development of ripples under conditions of high humidity, and deformation from string tension. The tendency of wood to crack under hot, dry conditions introduces further problems.

Accordingly, it is the general aim of the present invention to provide an improved guitar top or sounding board assembly for low cost manufacture which may be produced with a high degree of uniformity of physical characteristics to enable repeatability for uniform sound production. It is a further aim of the invention to provide an improved guitar top which is highly resistive to temperature change and which has a high stiffness to weight ratio for improved tonal quality.

SUMMARY OF THE INVENTION

In accordance with the present invention, a stringed musical instrument top comprises a single piece of plastic material which defines a relatively thin sounding board and which has a sound hole therethrough between its upper and lower ends. The top further includes a plurality of integral reinforcing ribs which project from the inner surface of the sounding board. The ribs include a plurality of annular ribs which surround the sound hole and a plurality of rectangular ribs which extend longitudinally of the sounding board between the sound hole and the lower end. Each of the rectilinear ribs intersects at least one of the annular ribs. Further, and in accordance with the invention, the plastic material comprises a composite material consisting of glass and resin.

DETAILED DESCRIPTION OF PREFERRED EMBODIMENT

Figure 2:
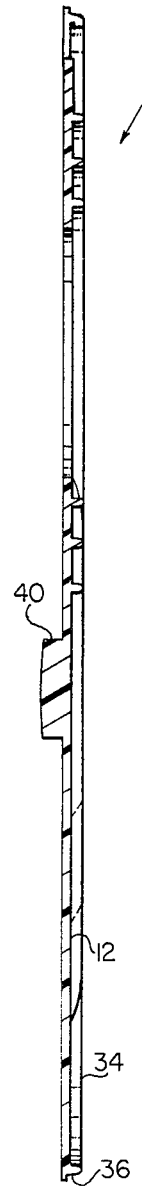
FIG. 2 is a sectional view taken along the line 2—2 of FIG. 1.

Turning now to the drawing, a guitar top embodying the present invention is indicated generally by the reference numeral 10. The guitar top 10 comprises a single piece of plastic material which defines a relatively thin sounding board 12 which has a sound hole 14 therethrough between its upper and lower ends. Preferably, and as shown the sound hole 14 is circular and located generally centrally of the sounding board, substantially as shown.

The guitar top 10 further includes a plurality of integral reinforcing ribs which project beyond the bottom or inner surface of the sounding board and which include annular ribs 16, 18 and 20 and rectilinear ribs designated by the numerals 22, 24, 26, 28, 30 and 32. The annular ribs 16, 18 and 20 are preferably circular and arranged in concentric relation to the sound hole 24 and to each other. The rectilinear ribs 22–32 extend longitudinally of the sounding board 12 between the sound hole 14 and the lower end of the sounding board and diverge relative to each other from the annular ribs 16–20 and in the direction of the lower end. Each rectilinear rib 22–32 intersects and crosses at least one of the annular ribs 16–20, to provide additional reinforcement in the region of the sounding board near the sound hole. More specifically, the rectilinear ribs 22 and 32 intersect and cross the annular rib 20 whereas the rectilinear ribs 24 and 30 intersect and cross both the annular ribs 18 and 20. The rectilinear ribs 26 and 28 which lie within a region generally parallel to the instrument strings (not shown) intersect and cross each of the annular ribs 16, 18 and 20 to provide additional reinforcement in this critical region of the sounding board. This reinforcing pattern has been found to provide great strength without impairing tonal quality of the instrument.

An integral liner or inner ring indicated at 34 is provided to facilitate assembly of the guitar top with the remainder of the guitar body (not shown). The remainder of the body may be of any suitable shape and may, for example, comprise a one-piece bowl or an assembly of separate parts which include a substantially flat bottom wall and a side wall. The liner 34 projects from the inner surface of the sounding board 12, extends along the outer marginal edge portion of the sounding board and has a laterally outwardly facing surface 36 which is generally normal to the sounding board 12. The linear 34 is adapted to generally complement the inner marginal surface of the guitar bowl adjacent the top edge of the bowl and, in assembly, is adhered to the latter surface of the bowl.

Figure 5:
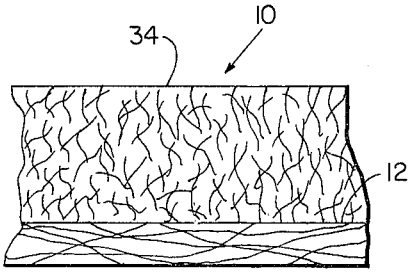
FIG. 5 is a somewhat enlarged schematic fragmentary sectional view taken along the line 5—5 of FIG. 1 and illustrates the general composition of the material from which the guitar top is made.
Figure 4:
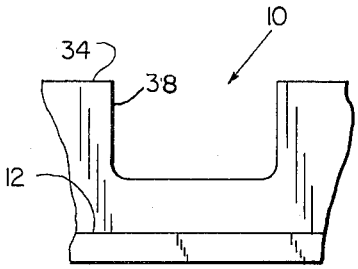
FIG. 4 is a somewhat enlarged fragmentary portion of the guitar top as viewed along the line 4—4 of FIG. 1.

Preferably, and as shown in FIGS. 5 and 6, the guitar top includes locating means for cooperating with one or more associated locating members on the guitar bowl to assure accurate registry between the top 10 and the bowl during assembly. In the illustrated embodiment the locating means comprises notches 38, 38 formed in the linear 34 for receiving associated locating members or bosses attached to the inner surface of the guitar bowl, not shown. Another notch 39 is formed in the upper end of the sounding board to accommodate a neck (not shown).

Figure 1:
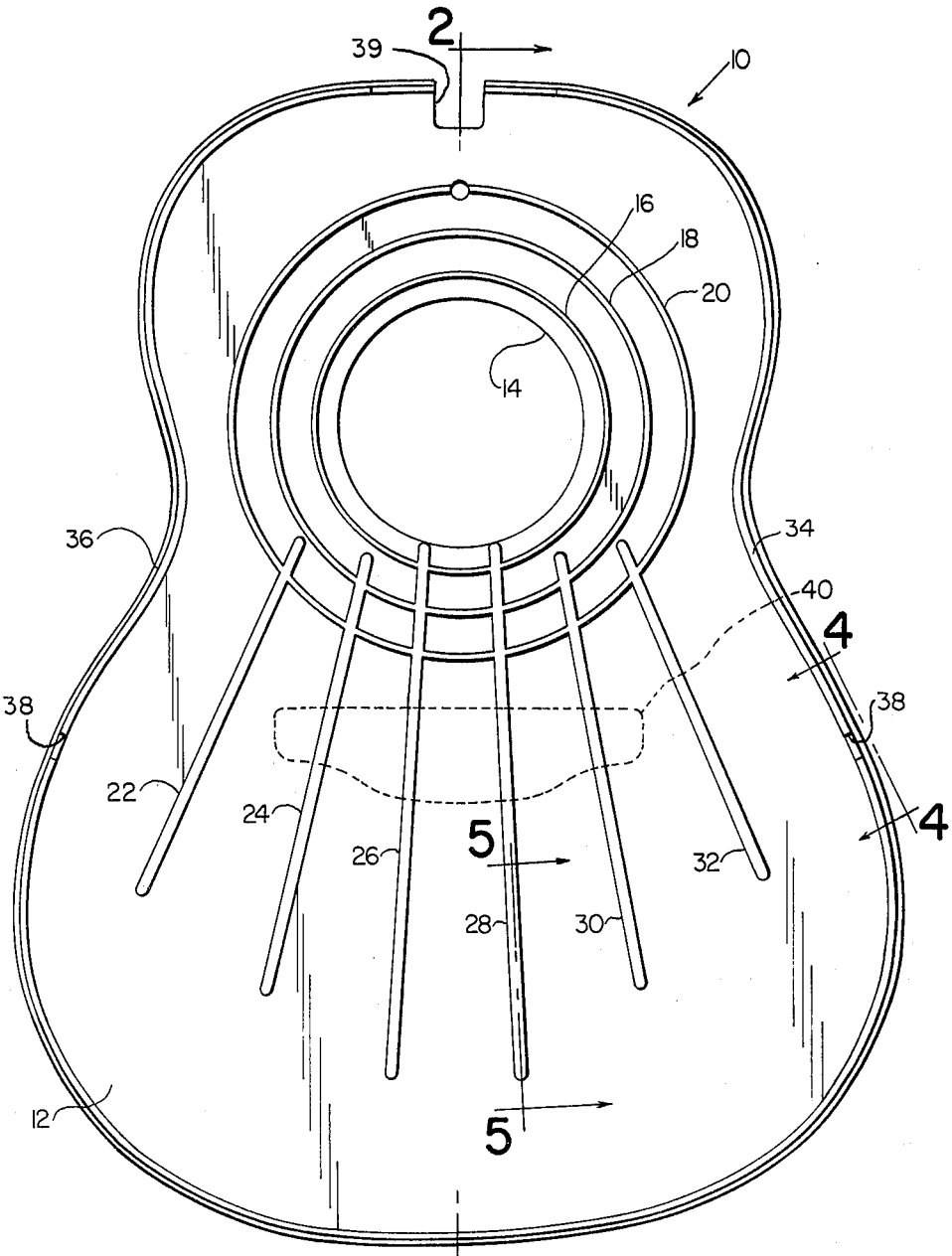
FIG. 1 is a bottom view of a guitar top embodying the present invention.
Figure 3:
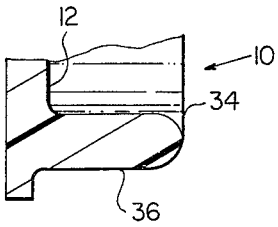
FIG. 3 is a somewhat enlarged fragmentary sectional view of the guitar top, as shown in FIG. 2.

The guitar top 10 may, if desired, be provided with an integral bridge such as indicated at 40 in FIGS. 1 and 2. The bridge 40 projects from the top or outer surface of the sounding board 12, as best shown in FIG. 2. As illustrated, the bridge 40 is of a generally conventional type and extends transversely of the sounding board 12 between the sound hole 14 and the lower end of the soundboard.

The illustrated guitar top 10 is molded from a thermosetting plastic sheet molding compound which preferably comprises 40% glass and 60% resin. The resin may, for example, comprise a polyester or epoxy material whereas the glass essentially comprises glass fibers, but may also include micro-balloons. Preferably, the thermosetting plastic material has a density greater than 1 and a shrink factor of approximately 0.5 mils per inch. A density of 1.22 is preferred, since it has been found that a guitar top made from a molded material of this density possesses the optimal characteristics desired. The micro-balloons present in the molding compound provide a means for controlling the density of the material.

The sounding board 12 is formed from a mat of random glass fibers of relatively long length. The majority of the fibers which comprise this mat material range from three inches to two feet in length and make up approximately 30% of the total 40% glass content of the guitar top 10. The remaining 10% of the glass content is in the form of relatively short random fibers, the majority of these short fibers being not greater than one-half inch in length. These short chopped glass fibers are arranged relative to the longer glass fibers in the mat so that the longer fibers form the sounding board 12 whereas the shorter chopped fibers form the reinforcing ribs 20–32 and the liner 34.

The use of relatively long fibers within the sounding board 12 provides the desired strength, hardness and flexibility essential to the provision of a high quality guitar. The use of shorter chopped fibers to form the reinforcing ribs or braces and the liner assures sufficient dispersement of fibers throughout the braces and liner to provide the necessary strength and flexibility for these parts.

When the guitar top is provided with an integral bridge, such as the bridge 40, the bridge is formed from random glass fibers, the majority of which are greater than one inch in length. This arrangement assures adequate dispersement of fibers within the bridge to resist tension applied to it by the strings of the instrument.

We claim:

1. A stringed musical instrument top comprising a single piece of plastic material defining a relatively thin sounding board having a sound hole therethrough between its upper and lower ends, a plurality of integral reinforcing ribs projecting from the inner surface of said sounding board, said reinforcing ribs including a plurality of annular ribs surrounding said sound opening and a plurality of rectilinear ribs extending longitudinally of said sounding board between said sound hole and said lower end, each of said rectilinear ribs intersecting at least one of said annular ribs.

2. A stringed musical instrument top as set forth in claim 1 wherein at least one of said rectilinear reinforcing ribs intersects each of said annular ribs.

3. A stringed musical instrument top as set forth in either claim 1 or claim 2 wherein said annular ribs are characterized as concentric circular ribs.

4. A stringed musical instrument top as set forth in claim 3 wherein said sound hole comprises a circular sound hole and said circular ribs are concentric with said sound hole.

5. A stringed musical instrument top as set forth in either claim 1 or claim 2 wherein said rectilinear ribs diverge relative to each other from said annular ribs and in the direction of said lower end.

6. A stringed musical instrument top as set forth in either claim 1 or claim 2 wherein said top includes an integral liner projecting from said inner surface and extending along the outer marginal edge portion of said sounding board.

7. A stringed musical instrument top as set forth in either claim 1 or claim 2 including an integral bridge projecting from the outer surface of said sounding board.

8. A stringed musical instrument top as set forth in claim 7 wherein said bridge extends transversely of said sounding board between said sound hole and said lower end.

9. A stringed musical instrument top as set forth in either claim 1 or claim 2 wherein said plastic material comprises a composite material formed of approximately 60% resin and 40% glass.

10. A stringed musical instrument top as set forth in claim 9 wherein said glass is further characterized as random glass fibers and at least 10% of said fibers are not greater than one-half inch in length.

11. A stringed musical instrument top as set forth in claim 10 wherein the majority of the remaining glass fibers are greater than 3 inches in length.

12. A stringed musical instrument top as set forth in either claim 1 or claim 2 wherein said plastic material comprises a composite material including resin and glass fibers and wherein said sounding board comprises a mat of random glass fibers the majority of which are greater than three inches in length and said reinforcing ribs comprise random glass fibers the majority of which are not greater than one-half inch in length.

13. A stringed musical instrument top as set forth in claim 12 wherein said composite material comprises approximately 60% resin and 40% glass.

14. A stringed musical instrument top as set forth in claim 13 wherein said composite material has a density greater than 1.

15. A stringed musical instrument top as set forth in claim 14 wherein said density is 1.22.

16. A stringed musical instrument top comprising a single piece of plastic material defining a relatively thin sounding board having a sound hole therethrough between its upper and lower ends, said top having a plurality of integral reinforcing ribs projecting from the inner surface of said sounding board, said reinforcing ribs including a plurality of circular ribs surrounding said sound opening and disposed in spaced relation to the periphery of said sound opening.

17. A stringed musical instrument top as set forth in claim 16 wherein said circular ribs are further characterized as concentric circular ribs.

* * * * *